US011324366B2

(12) United States Patent
Kim et al.

(10) Patent No.: US 11,324,366 B2
(45) Date of Patent: May 10, 2022

(54) VACUUM CLEANER

(71) Applicant: Samsung Electronics Co., Ltd., Suwon-si (KR)

(72) Inventors: Dong Jun Kim, Suwon-si (KR); Kyoung Woung Kim, Suwon-si (KR); Han Saem Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 180 days.

(21) Appl. No.: 16/361,461

(22) Filed: Mar. 22, 2019

(65) Prior Publication Data

US 2019/0290086 A1 Sep. 26, 2019

(30) Foreign Application Priority Data

Mar. 23, 2018 (KR) ..... 10-2018-0033770

(51) Int. Cl.
*A46B 13/00* (2006.01)
*A47L 9/00* (2006.01)
*A47L 9/04* (2006.01)

(52) U.S. Cl.
CPC ..... *A47L 9/0477* (2013.01); *A46B 13/001* (2013.01); *A47L 9/0072* (2013.01)

(58) Field of Classification Search
CPC ..... A46B 13/001; A46B 13/006; A47L 5/26; A47L 5/30; A47L 9/0072; A47L 9/0461; A47L 9/0477
USPC ..... 15/259, 319, 384; 55/DIG. 3
See application file for complete search history.

(56) References Cited

U.S. PATENT DOCUMENTS 1,792,992 A * 2/1931 Lerch ..... A47L 9/0483 15/382
2,893,046 A * 7/1959 Thompson ..... A47L 9/02 15/325
3,069,716 A * 12/1962 Smith ..... A47L 7/0009 15/371
3,186,023 A * 6/1965 McCulloch ..... A47L 9/02 15/364

(Continued)

FOREIGN PATENT DOCUMENTS

DE 102012208685 A1 * 11/2013 ..... A47L 9/0477
EP 2520209 11/2012

(Continued)

OTHER PUBLICATIONS

International Search Report dated Jul. 19, 2019 in corresponding International Patent Application No. PCT/KR2019/003384.

(Continued)

*Primary Examiner* — Joseph J Hail
*Assistant Examiner* — Arman Milanian
(74) *Attorney, Agent, or Firm* — Staas & Halsey LLP

(57) ABSTRACT

A vacuum cleaner includes a head unit that suctions foreign substances from a surface to be cleaned together with air. The head unit includes a first suction guide having a first suction chamber therein and a second suction guide disposed on a rear side of the first suction guide and having a second suction chamber therein, and the first suction chamber suctions air through a first degree of vacuum and the second suction chamber suctions air through a second degree of vacuum higher than the first degree of vacuum.

17 Claims, 5 Drawing Sheets

(56) References Cited

U.S. PATENT DOCUMENTS

| | | | | | |
|---|---|---|---|---|---|
| 3,210,792 | A * | 10/1965 | Sassano, Sr. | ..... | A47L 11/4036 15/401 |
| 4,624,025 | A * | 11/1986 | Kaulig | ..... | A47L 9/0411 15/384 |
| 5,539,953 | A * | 7/1996 | Kurz | ..... | A47L 9/06 15/367 |
| 7,150,068 | B1 | 12/2006 | Ragner | | |
| 2013/0174372 | A1* | 7/2013 | Guder | ..... | A47L 9/0613 15/363 |

FOREIGN PATENT DOCUMENTS

| | | | | | |
|---|---|---|---|---|---|
| GB | 2530931 | A * | 4/2016 | ..... | A47L 9/0477 |
| JP | 5-228083 | | 9/1993 | | |
| JP | 11-56705 | | 3/1999 | | |
| JP | 2015-154836 | | 8/2015 | | |
| KR | 10-2006-0109575 | | 10/2006 | | |
| KR | 10-2017-0049532 | | 5/2017 | | |

OTHER PUBLICATIONS

Written Opinion of the International Searching Authority dated Jul. 19, 2019 in corresponding International Patent Application No. PCT/KR2019/003384.

Extended European Search Report dated Mar. 12, 2021 in European Patent Application No. 19770316.8.

Chinese Office Action dated Jul. 9, 2021 from Chinese Application No. 201980021133.8.

* cited by examiner

VACUUM CLEANER

CROSS-REFERENCE TO RELATED APPLICATIONS

This application is based on and claims priority under 35 U.S.C. § 119 to Korean Patent Application No. 10-2018-0033770, filed on Mar. 23, 2018 in the Korean Intellectual Property Office, the disclosure of which is incorporated by reference herein in its entirety.

BACKGROUND

1. Field

The present disclosure relates to a vacuum cleaner, and more particularly, to a vacuum cleaner capable of cleaning fine dust more efficiently.

2. Description of the Related Art

A vacuum cleaner is a device that suctions and removes small foreign substances in the room.

The vacuum cleaner includes a main unit including a fan motor for generating a suction force, and a head unit that receives the suction force generated from the fan motor and suctions foreign substances on a surface to be cleaned together with air.

The head unit includes a suction chamber in which the suction force generated by the fan motor acts, and a rotary brush rotatably installed in the suction chamber to allow foreign substances on the surface to be cleaned to be more easily suctioned.

In such a vacuum cleaner, when the gap between the bottom surface of a front side of the head unit into which the foreign substances are mainly introduced and the surface to be cleaned is small, large-sized foreign substances do not reach the rotary brush, and thus it is difficult to clean the large-sized foreign substances. On the other hand, when the gap between the bottom surface of a front side of the head unit and the surface to be cleaned is large, the large-sized foreign substances do reach the rotary brush, but the degree of vacuum in the suction chamber is lowered, and thus it is difficult to clean small-sized foreign substances such as fine dust.

SUMMARY

It is an aspect of the present disclosure to provide a vacuum cleaner capable of simultaneously and efficiently suctioning small-sized foreign substances such as fine dust together with large-sized foreign substances.

Additional aspects of the present disclosure will be set forth in part in the description which follows and, in part, will be apparent from the description, or may be learned by practice of the present disclosure.

In accordance with an aspect of the present disclosure, a vacuum cleaner includes a head unit, wherein the head unit includes a first suction guide having a first suction chamber therein and a second suction guide disposed on a rear side of the first suction guide and having a second suction chamber therein, and the first suction chamber suctions air through a first degree of vacuum and the second suction chamber suctions air through a second degree of vacuum higher than the first degree of vacuum.

The vacuum cleaner further includes a foreign substance collecting space provided between the first suction guide and the second suction guide to form a space for collecting foreign substances, and a nozzle blade disposed in the foreign substance collecting space to restrict movement of foreign substances having sizes larger than a predetermined size to a rear side.

The nozzle blade partitions the foreign substance collecting space into a first foreign substance collecting portion connected to the first suction chamber and a second foreign substance collecting portion connected to the second suction chamber.

The nozzle blade is formed of an elastically deformable material.

The vacuum cleaner further includes a suction pipe portion connected to an upper portion of a central portion of the foreign substance collecting space, wherein the nozzle blade includes a pair of slits formed to be spaced from each other at a position corresponding to the suction pipe portion.

The suction pipe portion includes a partition wall that divides the inner space of the suction pipe portion into a front portion and a rear portion.

The vacuum cleaner further includes a first rotary brush rotatably installed in the first suction chamber to guide foreign substances to a rear side, and a second rotary brush rotatably installed in the second suction chamber to guide foreign substances to a front side, wherein the first suction guide and the second suction guide are formed to have an arc-shaped cross-section opened at a lower side.

The first suction guide includes foreign substance inlet grooves provided to be recessed at a lower end of a front portion of the first suction guide to allow foreign substances to be introduced into the first suction chamber.

The foreign substance inlet grooves include first foreign substance inlet grooves and second foreign substance inlet grooves smaller than the first foreign substance inlet grooves.

The first suction guide includes a grinder portion protruding downward from a lower end of a rear portion of the first suction guide, and the grinder portion is provided on a rear side of the first foreign substance inlet grooves.

The vacuum cleaner further includes sealing members disposed on a lower surface of the head unit to restrict the flow rate of air suctioned into the first suction chamber and the second suction chamber.

The sealing members include a pair of first side sealing members disposed on opposite sides of the first suction guide, a pair of second side sealing members disposed on opposite sides of the second suction guide, and a rear sealing member disposed on a rear side of the second suction guide.

In accordance with an aspect of the present disclosure, a vacuum cleaner includes a head unit, wherein the head unit includes a first suction guide having a first suction chamber therein, a second suction guide disposed on a rear side of the first suction guide and having a second suction chamber therein, a first rotary brush rotatably installed in the first suction chamber to guide foreign substances to a rear side, a second rotary brush rotatably installed in the second suction chamber to guide foreign substances to a front side, and a nozzle blade disposed in a space between the first suction guide and the second suction guide to restrict movement of foreign substances having sizes larger than a predetermined size to the first suction chamber.

BRIEF DESCRIPTION OF THE DRAWINGS

These and/or other aspects, features, and advantages of embodiments of the present disclosure will become apparent and more readily appreciated from the following description of the embodiments, taken in conjunction with the accompanying drawings of which.

DETAILED DESCRIPTION

Figure 1:
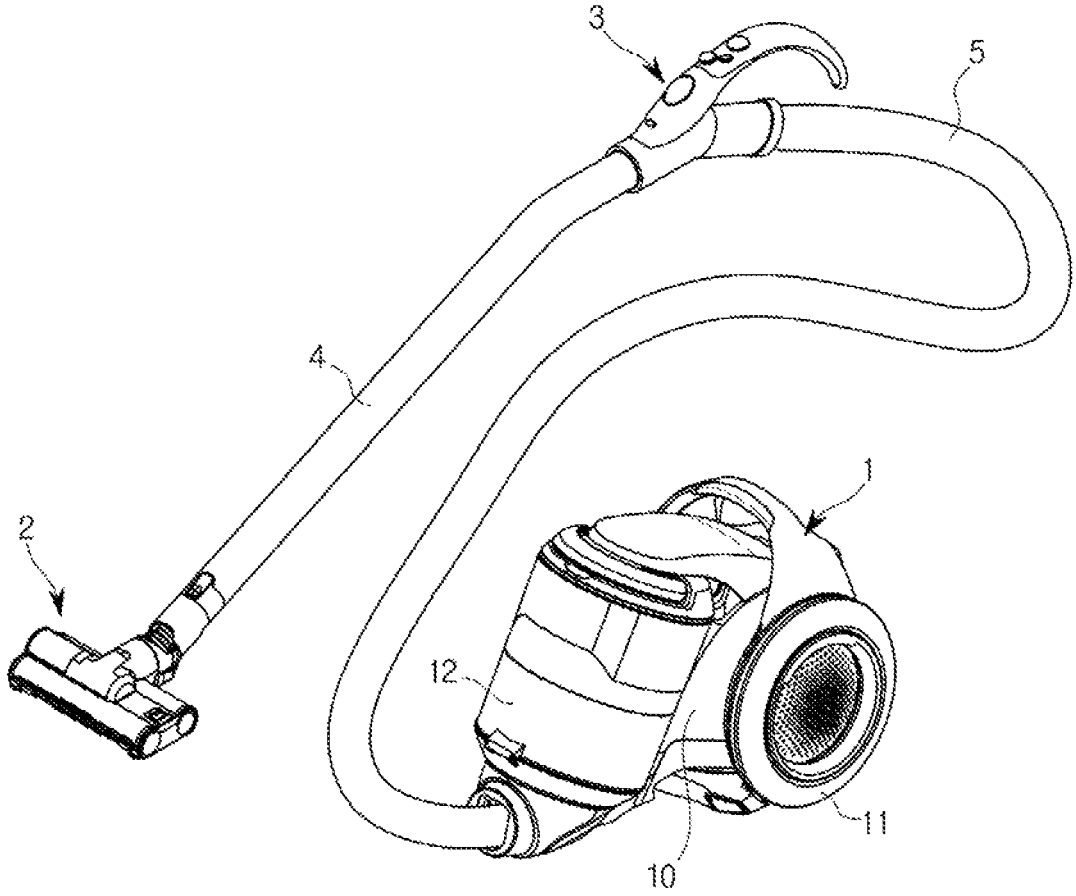
FIG. 1 is a perspective view of a vacuum cleaner according to an embodiment of the present disclosure.

The embodiments described herein and the configurations shown in the drawings are only examples of embodiments of the present disclosure, and various modifications may be made at the time of filing of the present disclosure to replace the embodiments and drawings of the present specification.

Like reference numbers or designations in the various figures of the present application represent parts or components that perform substantially the same functions.

The terms used herein are for the purpose of describing the embodiments and are not intended to restrict and/or to limit the disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

Although a head unit of the present disclosure may be applied to a handy type vacuum cleaner, a stick type vacuum cleaner, and a canister type vacuum cleaner, in the following embodiments, an example in which the head unit of the present disclosure is applied to the canister type vacuum cleaner will be described.

Hereinafter, embodiments according to the present disclosure will be described in detail with reference to the accompanying drawings.

Figure 2:
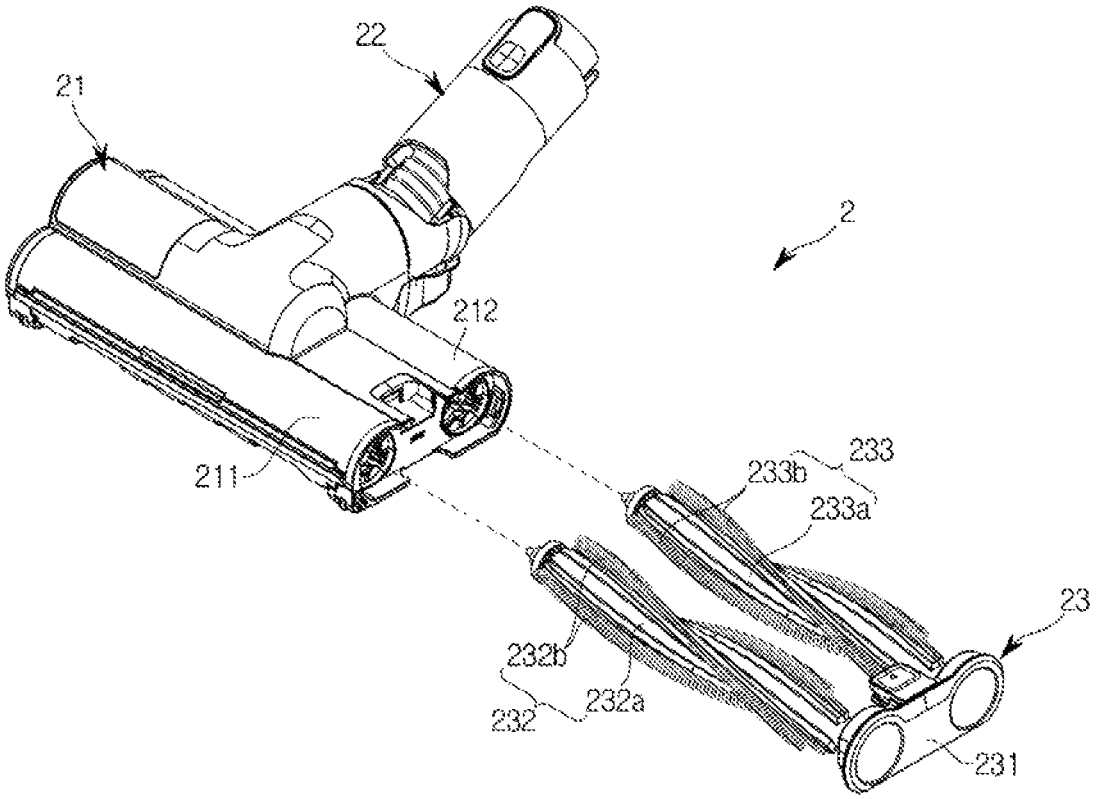
FIG. 2 is an exploded perspective view of a head unit applied to a vacuum cleaner according to an embodiment of the present disclosure.
Figure 3:
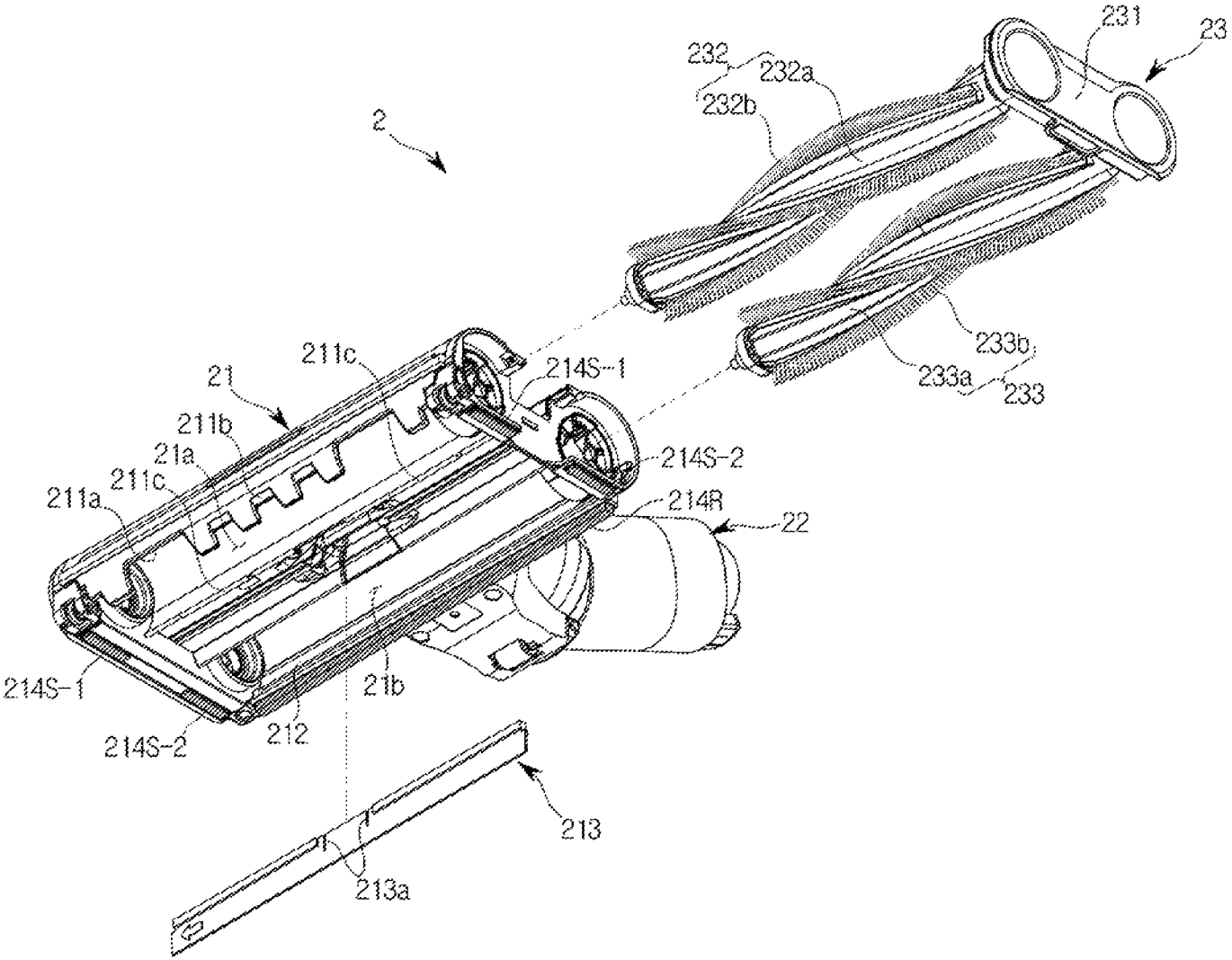
FIG. 3 is an exploded bottom perspective view of a head unit applied to a vacuum cleaner according to an embodiment of the present disclosure.

FIG. 1 is a perspective view of a vacuum cleaner according to an embodiment of the present disclosure, FIG. 2 is an exploded perspective view of a head unit of the vacuum cleaner illustrated in FIG. 1, and FIG. 3 is an exploded bottom perspective view of the head unit illustrated in FIG. 2.

As illustrated in FIG. 1, a vacuum cleaner according to an embodiment of the present disclosure includes a main unit 1 configured to generate a suction force, a head unit 2 configured to receive the suction force and suction foreign substances, or debris, on a surface to be cleaned together with air, and a handle unit 3 configured to allow a user to easily move the head unit 2.

The main unit 1 is connected to the handle unit 3 through a flexible tube 5 and the head unit 2 is connected to the handle unit 3 through an extension pipe 4. Therefore, the suction force generated from the fan motor (not shown) of the main unit 1 is transferred to the head unit 2 through the flexible tube 5 and the extension pipe 4.

The main unit 1 includes a main housing 10 forming an outer appearance of the main unit 1, a pair of wheels 11 respectively disposed on opposite sides of the main housing 10 so that the main unit 1 may be moved by the user, and a dust collecting device 12 to generate a suction force using a fan motor and a filter.

As illustrated in FIGS. 2 and 3, the head unit 2 includes a head body 21, a connection pipe 22 rotatably installed on a rear end side of the head body 21 and coupled to the extension pipe 4, and a brush module 23 including first and second rotary brushes 232 and 233 and detachably coupled to the head body 21.

The head body 21 includes a first suction guide 211 provided to form a first suction chamber 21*a* for suctioning air through a first degree of vacuum, or a first vacuum pressure, a second suction guide 212 provided to form a second suction chamber 21*b* for suctioning air through a second degree of vacuum, or a second vacuum pressure, higher than, or stronger than, the first degree of vacuum, a foreign substance collecting space 21*c* provided between the first suction guide 211 and the second suction guide 212 to form a space for collecting foreign substances, and a suction pipe portion 21*d* connected to an upper portion of the foreign substance collecting space 21*c* to transmit the suction force to the foreign substance collecting space 21*c*.

Figure 4:
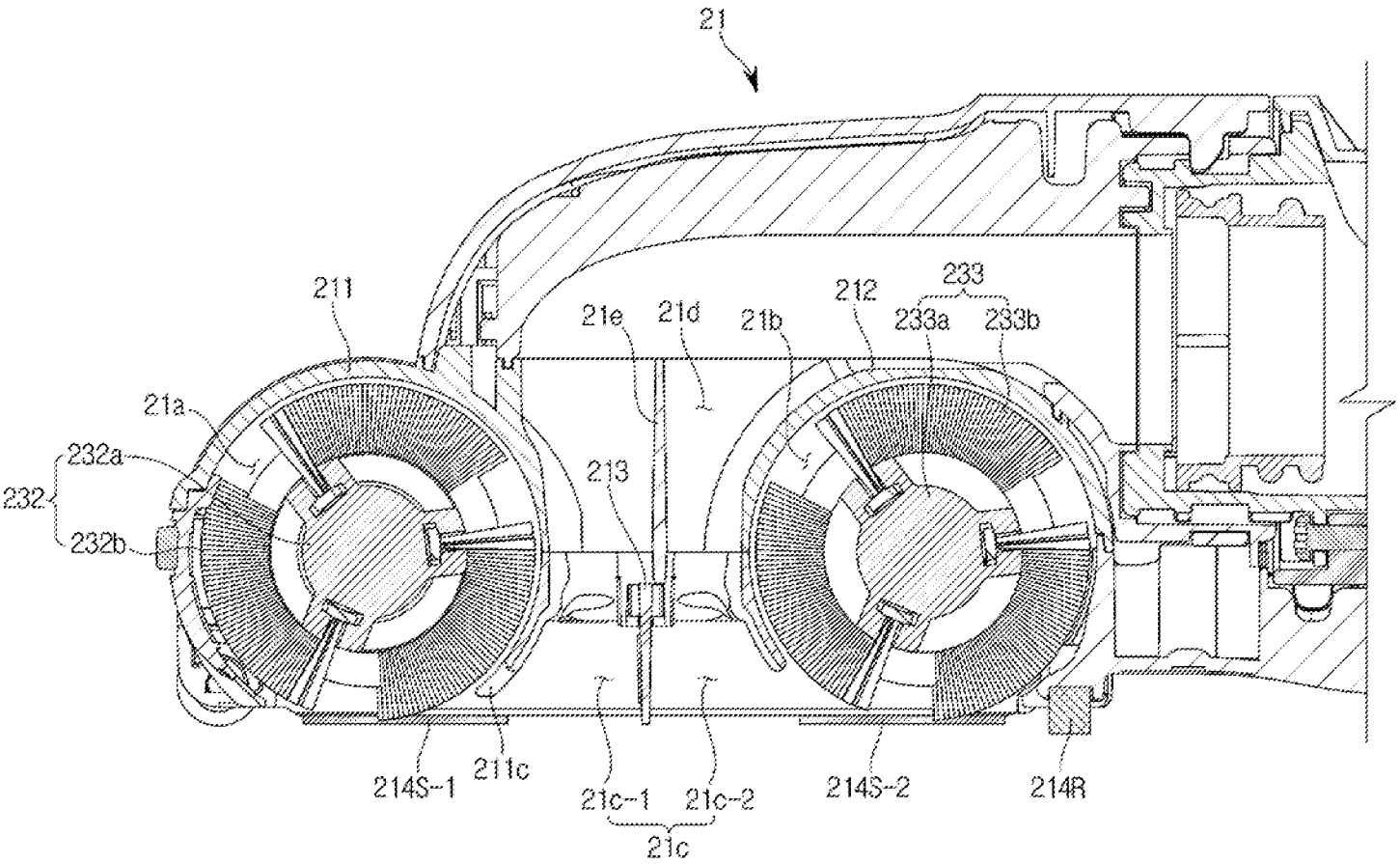
FIG. 4 is a cross-sectional view of a head unit applied to a vacuum cleaner according to an embodiment of the present disclosure.

As illustrated in FIG. 4, the first suction guide 211 and the second suction guide 212 are formed to have an arc-shaped cross section with a lower side opened, and extend laterally on a lower portion of the head body 21. The first rotary brush 232 of the brush module 23 is rotatably installed inside the first suction guide 211, and the second rotary brush 233 of the brush module 23 is rotatably installed inside the second suction guide 212.

The second suction guide 212 is disposed to be spaced apart from the rear of the first suction guide 211, and the foreign substance collecting space 21*c* is formed in a space between the first suction guide 211 and the second suction guide 212 which are spaced apart from each other. Accordingly, the foreign substance collecting space 21*c* also extends laterally in the same manner as the first and second suction guides 211 and 212.

Figure 5:
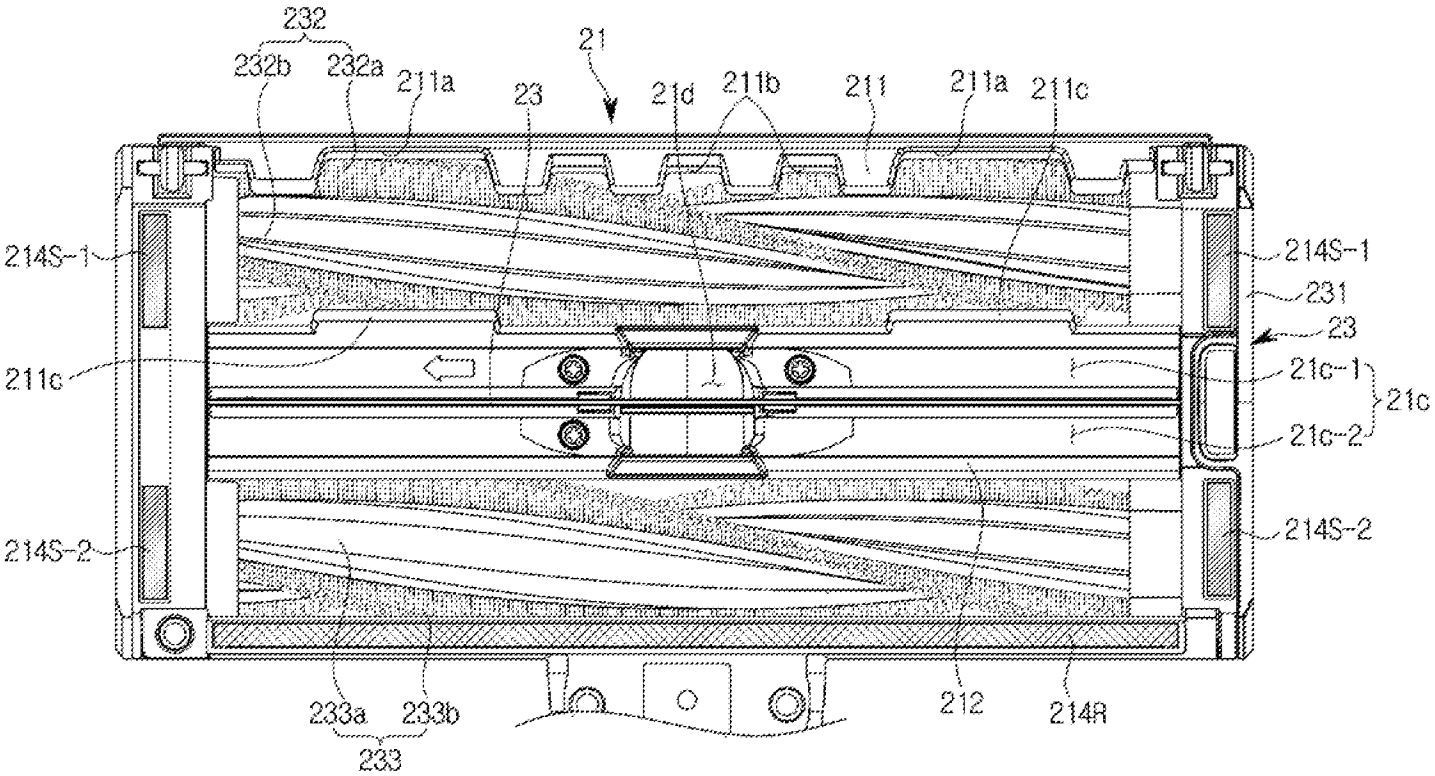
FIG. 5 is a bottom view of a head unit applied to a vacuum cleaner according to an embodiment of the present disclosure.

As illustrated in FIG. 5, foreign substance inlet grooves 211*a* and 211*b* for allowing foreign substances to be introduced into the first suction chamber 21*a* are provided to be recessed at a lower end of a front portion of the first suction guide 211. In the present embodiment, the foreign substance inlet grooves 211*a* and 211*b* include the first foreign substance inlet grooves 211*a*, and the second foreign substance inlet grooves 211*b* provided to be smaller than the first foreign substance inlet grooves 211*a*. In the present embodiment, three of the second foreign substance inlet grooves 211*b* are provided on a central portion of the first suction guide 211, and the first foreign substance inlet grooves 211*a* are provided on opposite sides of the first suction guide 211.

Grinder portions 211*c* protruding downward for crushing foreign substances together with the first rotary brush 232 is provided at a lower end of a rear portion of the first suction guide 211. The grinder portions 211*c* extend in an arc shape like the first suction guide 211 and are provided on a rear side of the first foreign substance inlet grooves 211*a*. Accordingly, large-sized foreign substances introduced into the first suction chamber 21*a* through the first foreign substance inlet grooves 211*a* move to the rear side, and then are crushed to a small size by the first rotary brush 232 and the grinder portions 211*c* so as to be suctioned into the suction pipe portion 21*d*.

Herein, the first and second rotary brushes 232 and 233 and the grinder portions 211*c* are not capable of crushing all kinds of foreign substances, and foreign substances of a kind which is large but easily breakable, like a biscuit, for example, are mainly crushed.

As illustrated in FIGS. 3 and 4, the head body 21 further includes a nozzle blade 213 for partitioning the foreign substance collecting space 21*c* into a front portion and a rear portion to restrict foreign substances having sizes larger than a predetermined size from moving toward the first suction chamber 21*a*. The nozzle blade 213 is separately formed of an elastically deformable material and then installed in the foreign substance collecting space 21*c*. The nozzle blade 213 is formed in the shape of a rectangular plate extending laterally to correspond to the foreign substance collecting space 21*c*. A lower end of the nozzle blade 213 extends to be positioned adjacent to the surface to be cleaned, so that the nozzle blade 213 serves as a kind of nozzle for increasing the flow rate of the air between the lower end of the nozzle blade 213 and the surface to be cleaned.

The foreign substance collecting space 21*c* is divided into a first foreign substance collecting portion 21*c*-1 to collect foreign substances moved backward by the first rotary brush 232 and a second foreign substance collecting portion 21*c*-2 to collect foreign substances moved forward by the second rotary brush 233. The first foreign substance collecting portion 21*c*-1 communicates with the first suction chamber 21*a* as a space provided on a front side of the nozzle blade 213, and the second foreign substance collecting portion 21*c*-2 communicates with the second suction chamber 21*b* as a space provided on a rear side of the nozzle blade 213.

The suction pipe portion 21*d* is connected to an upper center portion of the foreign substance collecting space 21*c*. The suction pipe portion 21*d* is provided at a position corresponding to the nozzle blade 213 and a partition wall 21*e* for partitioning the suction pipe portion 21*d* into a front portion and a rear portion is provided in the suction pipe portion 21*d*. Accordingly, the suction force acting on the suction pipe portion 21*d* is divided through the partition wall 21*e* and the nozzle blade 213 and is transferred to the first foreign substance collecting portion 21*c*-1 and the second foreign substance collecting portion 21*c*-2.

The nozzle blade 213 described above includes a pair of slits 213*a* formed to be spaced from each other at a position corresponding to the suction pipe portion 21*d*. Therefore, when a large-sized foreign substance is suctioned into the suction pipe portion 21*d*, a portion between the slits 213*a* in the nozzle blade 213 may be temporarily elastically deformed.

As illustrated in FIG. 5, the head body 21 includes sealing members 214S-1, 214S-2, and 214R disposed on a lower surface of the head body 21 to regulate the flow rate of air flowing into the first suction chamber 21*a* and the second suction chamber 21*b*. The sealing members 214S-1, 214S-2, and 214R include a pair of the first side sealing members 214S-1 disposed on opposite sides of the first suction guide 211, a pair of the second side sealing members 214S-2 disposed on opposite sides of the second suction guide 212, and the rear sealing member 214R disposed on a rear side of the second suction guide 212.

Accordingly, the flow rate of the air suctioned into the first suction chamber 21*a* through a space between the surface to be cleaned and the lower surface of the head body 21 is restricted by the first side sealing members 214S-1, and the flow rate of the air suctioned into the second suction chamber 21*b* is restricted by the second side sealing members 214S-2 and the rear sealing member 214R.

In this case, air may be more easily suctioned into the first suction chamber 21*a* because the first suction guide 211 is provided with the first and second foreign substance inlet grooves 211*a* and 211*b*. Therefore, even if the suction force of the same level is transferred to the first suction chamber 21*a* and the second suction chamber 21*b* through the foreign substance collecting space 21*c*, the first degree of vacuum in the first suction chamber 21*a* is formed lower than the second degree of vacuum in the second suction chamber 21*b*.

Thus, the air introduced into the first suction chamber 21*a*, on which the first degree of vacuum acts, is suctioned into the suction pipe portion 21*d* after passing through the first suction chamber 21*a* at a relatively slow speed, while the air introduced into the second suction chamber 21*b*, on which the second degree of vacuum acts, is suctioned into the suction pipe portion 21*d* after passing through the second suction chamber 21*b* at a relatively fast speed.

Accordingly, foreign substances having a relatively large size among the foreign substances introduced from the front side of the head unit 2 pass through the first suction chamber 21*a* and are then transferred to the first foreign substance collecting portion 21*c*-1. The large-sized foreign substances are restricted from moving backward by the nozzle blade 213, and thus are suctioned into the suction pipe portion 21*d* at the upper side.

On the other hand, small-sized foreign substances such as fine dust pass through the first suction chamber 21*a* and are then transferred to the second foreign substance collecting portion 21*c*-2.

Because the second degree of vacuum higher than the first degree of vacuum acts on the second suction chamber 21*b*, the small-sized foreign substances pass through the space between the surface to be cleaned and the nozzle blade 213, move to the second foreign substance collecting portion 21*c*-2, and then are suctioned into the upper suction pipe portion 21*d*.

Therefore, through the first and second foreign substance inlet grooves 211*a* and 211*b*, large-sized foreign substances may be suctioned, while small-sized foreign substances such as fine dust may be efficiently suctioned.

The brush module 23 includes a brush cover 231 removably installed on one side of the head body 21, and the first rotary brush 232 and the second rotary brush 233 rotatably mounted on the inner surface of the brush cover 231. Although not shown in the drawings, the head unit 2 includes a driving device for rotating the first rotary brush 232 and the second rotary brush 233.

The first rotary brush 232 is installed in the first suction chamber 21*a* formed by the first suction guide 211 and rotates to guide foreign substances to the rear side. The second rotary brush 233 is installed in the second suction chamber 21*b* formed by the second suction guide 212 and rotates to guide foreign substances to the front side. That is, the first rotary brush 232 guides foreign substances to the first foreign substance collecting portion 21*c*-1 positioned at the rear side thereof, and the second rotary brush 233 guides foreign substances to the second foreign substance collecting portion 21*c*-2 positioned at the front side thereof.

The first rotary brush 232 and the second rotary brush 233 respectively include brush bodies 232*a* and 233*a* formed in a cylindrical shape and rotatably installed on the brush cover 231 and the head body 21, and brush portions 232*b* and 233*b* protruding in a radial direction from the brush bodies 232*a* and 233*a* to sweep foreign substances on the surface to be cleaned upward. A plurality of the brush portions 232*b* and 233*b* extend in a spiral direction on outer surfaces of the brush bodies 232*a* and 233*a* and are arranged to be spaced apart in a circumferential direction.

In the present embodiment, although the first and second inlet grooves 211*a* and 211*b* are provided for allowing the foreign substances on a front lower side of the first suction guide 211 to be easily introduced into the first suction chamber 21*a*, this is merely an example. That is, the gap between the surface to be cleaned and the front-side lower end of the first suction guide 211 may be formed to be larger than the gap between the surface to be cleaned and the lower end of the nozzle blade 213. In this case as well, the second suction chamber 21*b* may have a higher degree of vacuum than the first suction chamber 21*a*, so that small-sized foreign substances may be efficiently suctioned.

In the present embodiment, the nozzle blade 213 is formed of an elastically deformable material and then coupled to the head body 21, but this is merely an example, and the nozzle blade may be formed integrally with the head body 21.

As is apparent from the above, a vacuum cleaner according to an aspect of the present disclosure can suction large-sized foreign substances through a first suction chamber that suctions air at a first degree of vacuum while efficiently suctioning fine dust of small particles through a second suction chamber that rapidly suctions air at a second degree of vacuum higher than the first degree of vacuum.

The embodiments disclosed with reference to the accompanying drawings have been described above. It will be understood by those skilled in the art that various changes in form and details may be made therein without departing from the spirit and scope of the present disclosure as defined by the appended claims.

What is claimed is:

1. A vacuum cleaner including a head unit, the head unit comprising:

a suction pipe configured to transfer a suction force;

a first suction chamber in communication with the suction pipe and configured to use the suction force to suction debris having a first size from a surface at a first vacuum pressure;

a second suction chamber, separated from the first suction chamber, provided behind the first suction chamber relative to a direction of travel of the head unit, in communication with the suction pipe, and configured to use the suction force to suction debris, having passed under the first suction chamber and having a second size smaller than the first size, from the surface at a second vacuum pressure stronger than the first vacuum pressure;

a debris collecting space provided between the first suction chamber and the second suction chamber to collect the debris; and a nozzle blade having a pair of slits formed spaced apart from each other and on a portion of the nozzle blade, the nozzle blade disposed in the debris collecting space, and partitions the debris collecting space into a first debris collecting space connected to the first suction chamber and a second debris collecting space connected to the second suction chamber, and configured to prevent the debris having the first size suctioned through the first suction chamber from being moved to the second suction chamber while allowing debris having the second size suctioned through the first suction chamber to be moved to the debris collecting space.

2. The vacuum cleaner according to claim 1, wherein the second suction chamber is separated from the first suction chamber by the nozzle blade.

3. The vacuum cleaner according to claim 2, wherein:

the nozzle blade protrudes toward the surface to increase an air flow between the nozzle blade and the surface.

4. The vacuum cleaner according to claim 2, wherein:

the nozzle blade is formed of an elastically deformable material.

5. The vacuum cleaner according to claim 2, further comprising:

a partition wall extending from an opening of the suction pipe to the nozzle blade to separate the second suction chamber from the first suction chamber.

6. The vacuum cleaner according to claim 1, further comprising:

a first rotary brush rotatably installed in the first suction chamber and configured to rotate in a first direction to guide debris to the first suction chamber;

a second rotary brush rotatably installed in the second suction chamber and configured to rotate in a second direction opposite to the first direction to guide debris to the second suction chamber;

a first suction guide provided around the first suction chamber and the first rotary brush; and a second suction guide provided around the second suction chamber and the second rotary brush, wherein the first suction guide and the second suction guide are formed to have an arc-shaped cross-section opened at a lower side of the head unit toward the surface.

7. The vacuum cleaner according to claim 6, wherein:

the first suction guide includes inlet grooves at a lower end of a front portion of the first suction guide to allow debris on the surface to pass under the first suction guide.

8. The vacuum cleaner according to claim 7, wherein:

the inlet grooves include:

first inlet grooves having a first size, and second inlet grooves having a second size smaller than the first size.

9. The vacuum cleaner according to claim 8, wherein:

the first suction guide includes a grinder protruding downward from a lower end of a rear side of the first suction guide, and the grinder is provided behind the first inlet grooves.

10. The vacuum cleaner according to claim 1, further comprising:

air restrictors disposed on a lower surface of the head unit to restrict the flow rate of air suctioned into the first suction chamber and the second suction chamber, and thereby establishing the second vacuum pressure stronger than the first vacuum pressure.

11. The vacuum cleaner according to claim 10, wherein:

the air restrictors include a pair of first side sealing members respectively disposed on opposite sides of the first suction guide, a pair of second side sealing members respectively disposed on opposite sides of the second suction guide, and a rear sealing member disposed on a rear side of the second suction guide.

12. A vacuum cleaner including a head unit, the head unit comprising:

a first suction guide having a first suction chamber in which a first vacuum pressure is applied, a second suction guide disposed on a rear side of the first suction guide relative to a direction of travel of the head unit, and having a second suction chamber in which a second vacuum pressure is applied, a first rotary brush rotatably installed in the first suction chamber and configured to guide debris to a rear side of the first rotary brush, a second rotary brush rotatably installed in the second suction chamber and configured to guide debris to a front side of the second rotary brush, a debris collecting space provided between the first suction chamber and the second suction chamber to collect the debris, and a nozzle blade having a pair of slits formed spaced apart from each other and on a portion of the nozzle blade, the nozzle blade disposed in the debris collecting space, and partitions the debris collecting space into a first debris collecting space connected to the first suction chamber and a second debris collecting space connected to the second suction chamber, and configured to prevent debris, having a size larger than a predetermined size, in the first suction chamber from moving to the second suction chamber while allowing debris, having a second size smaller than the predetermined size, in the first suction chamber to be moved to the collecting space.

13. The vacuum cleaner according to claim 12, wherein:

the first suction chamber is configured to suction air through the first vacuum pressure, and the second suction chamber is configured to suction air through the second vacuum pressure stronger than the first vacuum pressure.

14. The vacuum cleaner according to claim 12, wherein:

the nozzle blade is formed of an elastically deformable material.

15. The vacuum cleaner according to claim 12, wherein:

the first suction guide includes first inlet grooves at a lower end of a front side of the first suction guide, and second inlet grooves at a lower end of a front side of the first suction guide, wherein the second inlet grooves are smaller than the first inlet grooves.

16. The vacuum cleaner according to claim 15, wherein:

the first suction guide includes a grinder protruding downward from a lower end of a rear side of the first suction guide, and the grinder is provided behind the first inlet grooves.

17. A head unit for a vacuum cleaner, the head unit configured to receive a suction force to suction debris from a surface into the head unit and comprising:

a first suction chamber configured to use the suction force to suction debris having a first size, greater than a threshold size, from the surface through a first vacuum pressure applied to the first suction chamber;

a second suction chamber configured to use the suction force to suction debris, having a second size, smaller than the first size, from the surface through a second vacuum pressure stronger than the first vacuum pressure applied to the second suction chamber;

a partition provided between the first suction chamber and the second suction chamber to separate the first suction chamber from the second suction chamber;

a debris collecting space provided below the partition and between the first suction chamber and the second suction chamber to collect the debris;

a nozzle blade having a pair of slits formed spaced apart from each other and on a portion of the nozzle blade, the nozzle blade disposed in the debris collecting space, and partitions the debris collecting space into a first debris collecting space connected to the first suction chamber and a second debris collecting space connected to the second suction chamber, and configured to prevent debris having the first size, moving to the second suction chamber from the first suction chamber while allowing debris having the second size move from the first suction chamber to the collecting space; and an air restrictor provided on a lower surface of the head unit, and configured to reduce an air gap between the lower surface of the head unit and the surface to thereby restrict a flow of air through the air gap into the second suction chamber so that the second vacuum pressure stronger than the first vacuum pressure is applied in the second suction chamber.

* * * * *